United States Patent [19]

Romer et al.

[11] Patent Number: 4,763,577

[45] **Date of Patent: * Aug. 16, 1988**

[54] CARTRIDGE AMMUNITION WITH AT LEAST A PARTIALLY COMBUSTIBLE PROPELLANT CHARGE CARTRIDGE CASING

[75] Inventors: Rudolf Romer, Kaarst; Juergen Winkelmann, Meerbusch; Horst Sabinski, Kaarst, all of Fed. Rep. of Germany

[73] Assignee: Rheinmetall GmbH, Duesseldorf, Fed. Rep. of Germany

[ * ] Notice: The portion of the term of this patent subsequent to Apr. 24, 2001 has been disclaimed.

[21] Appl. No.: 843,709

[22] Filed: Mar. 25, 1986

Related U.S. Application Data

[63] Continuation-in-part of Ser. No. 242,911, Mar. 11, 1981, abandoned, which is a continuation-in-part of Ser. No. 54,152, Jun. 25, 1979, Pat. No. 4,444,115.

[30] Foreign Application Priority Data

Mar. 12, 1980 [DE] Fed. Rep. of Germany ..... 3009342

[51] Int. Cl.[4] ..... F42B 5/16

[52] U.S. Cl. ..... 102/431; 102/430; 102/464; 102/523

[58] Field of Search ..... 102/430–433, 102/439, 700, 703, 520–523, 464, 466, 467, 469, 470; 89/1.806, 1.812

[56] References Cited

U.S. PATENT DOCUMENTS

| | | | |
|---|---|---|---|
| 421,307 | 2/1890 | Reynolds | 89/1.806 |
| 2,971,429 | 2/1961 | Potts | 102/430 |
| 3,547,030 | 12/1970 | Kamp | 102/430 |
| 3,613,587 | 10/1971 | King | 102/433 |
| 3,901,153 | 8/1975 | Brabets et al. | 102/433 |
| 3,981,246 | 9/1976 | Luther et al. | 102/521 |
| 4,000,697 | 1/1977 | Levine | 102/433 |
| 4,159,678 | 7/1979 | Luther et al. | 102/431 |
| 4,444,115 | 4/1984 | Romer et al. | 102/523 |

FOREIGN PATENT DOCUMENTS

| | | | |
|---|---|---|---|
| 1013202 | 8/1957 | Fed. Rep. of Germany | 102/430 |
| 2456617 | 6/1975 | Fed. Rep. of Germany | 102/700 |
| 79338 | 6/1932 | Sweden | 102/439 |
| 765170 | 1/1957 | United Kingdom . | |

*Primary Examiner*—Harold J. Tudor

[57] ABSTRACT

An improved cartridge ammunition which includes an at least partially combustible shell casing and a projectile with a fin-stabilizing tail section mounted in a neck portion of the shell casing which thereby forms a first connection between the projectile and shell casing. A second connection between the projectile and shell casing is formed by means of a support element which is form-lockingly connected to both. The shell casing has a support region axially extending forwardly inside the shell casing from its bottom. The support element being mounted on said support region and being instrumental in assuring, due to its form-locking connections, that a predetermined axial force occurs in said support of element prior to disintegration thereof, between the tail section and the support region due to gas pressure build-up in the shell casing at firing of the ammunition.

4 Claims, 9 Drawing Sheets

CARTRIDGE AMMUNITION WITH AT LEAST A PARTIALLY COMBUSTIBLE PROPELLANT CHARGE CARTRIDGE CASING

CROSS-REFERENCE TO RELATED APPLICATIONS

This application is a continuation-in-part of our copending application Ser. No. 242,911, filed on Mar. 11, 1981, now abandoned, which is in turn a continuation-in-part application of Ser. No. 054,152, filed on June 25, 1979, now U.S. Pat. No. 4,444,115, and entitled CARTRIDGE-TYPE MUNITION HAVING A DESTRUCTIBLE OR PARTIALLY COMBUSTIBLE CASING.

BACKGROUND OF THE INVENTION

The latter-mentioned parent application is directed to a cartridge ammunition with at least a partially combustible propellant charge cartridge casing, which includes, among other embodiments, radially extending support elements disposed in the combustible casing for securing and supporting the projectile in the cartridge casing. Such ammunition is generally less compact and strong then comparable ammunition having metallic casings. These radially extending support elements described in the parent application have proven to be effective in improving the handling of such ammunition by service personnel, so that despite shocks, blows and bending stresses imparted to such ammunition, no permanent damage is caused thereto and the ammunition can be continued to be used in a flaw-free manner. However, certain phenomena were observed, which are traceable to that, after firing, the projectile begins to move already prior to the full build-up of gas pressure for the initial expulsion by the propellant gas. This can considerably inhibit the reproducability of results, which are generally achievable when preponderantly identical external conditions are present.

SUMMARY OF THE INVENTION

It is a general object of this invention, to provide initial conditions in cartridge ammunition of the aforedescribed type for the purpose of enhancing more rigorously the reproducability of internal ballistic conditions in the Cartridge ammunition.

BRIEF DESCRIPTION OF THE DRAWINGS

Referring to FIG. 1 a tail portion 10 of a fully illustrated projectile, having a fin-stabilizing arrangement 12, extends into the inner space 70 of a partially combustible cartridge casing, consisting of a metallic stump shell casing 20 and a combustible casing portion 60 which is only schematically partially illustrated. A bottom 22 of the stump shell casing is provided in a central region thereof with an inner projection 25 having an inner central bore 25' for accommodating a propellant charge ignition fuse therein (not illustrated for sake of clarity). A casing-like coupling or support region 44 extends along a central longitudinal axis over an external surface region of the inner projection 25. A support element 40, formed as a pipe having a plurality of radially extending ignition openings 54, is form-lockingly mounted on the stump shell casing 20. This form-locking can be provided by means of a non-illustrated threaded connection; it can alternately or additionally be provided by means of a glued joint. The support element 40 extends with a frontal end-face 41 into the rear mounting region 42, wherein it is form-lockingly connected to the rear surface 11 by means of a glued joint (not illustrated in detail). A wall 28 of the stump casing has, at its inner side, between the bottom 22 and a frontal end face 30, a stepped surface 32 which serves as part of a receiving surface 62 for receiving and supporting the rear end region 60 of a shell casing. The shell casing 60 extends in an axial direction along axis A up to a non-illustrated casing neck portion, in which region it is connected to the projectile proper. The internal space 70 of the casing serves to accommodate a propelllant charge therein. In this first embodiment of the invention, the support element 40 is made out of a material which corresponds to the material of the combustible shell casing 60.

Figure 1:
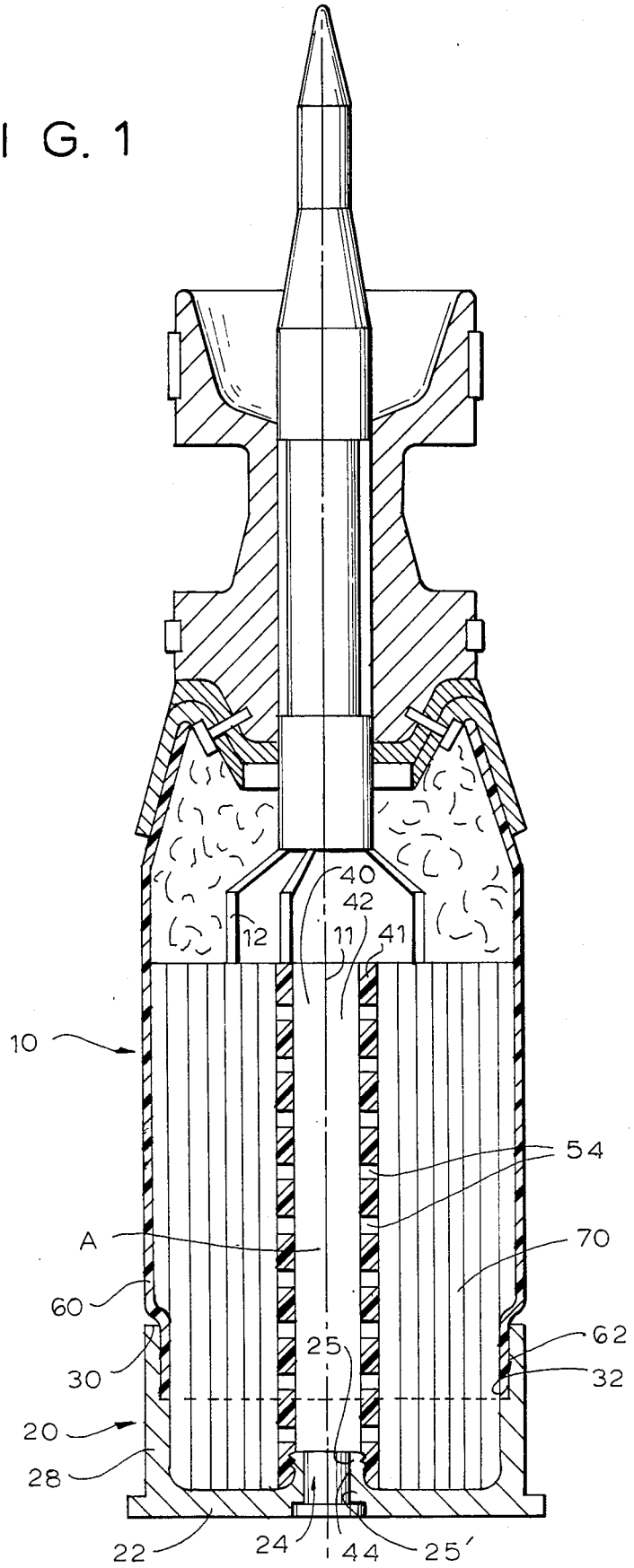
FIGS. 1–10 illustrate in axial cross-sections rotationally symmetrical halves of ten different embodiments of the ammunition of the invention in which insignificant details of the invention have been omitted. In the embodiments of FIGS. 1, 2, 9 and 10 a stump shell casing having an inner stepped wall is provided, whereas the wall thickness of the respective stump shell casing in the embodiments of FIGS. 3–8 increases continuously from a frontal edge portion towards the cartridge casing bottom.
Figure 2:
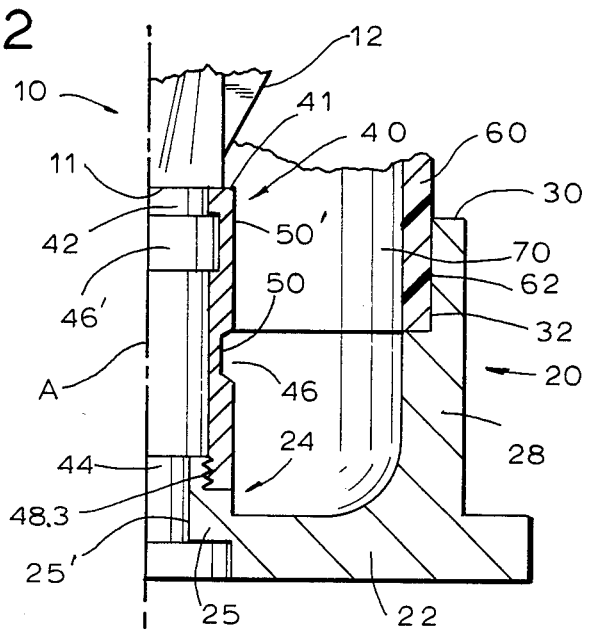

In the embodiment in accordance with FIG. 2 of the drawing the support element 40 is again of cylindrical shape. In the coupling region 44 of this embodiment, at the bottom of the stump shell casing 20, the support element 40 is form-lockingly connected by means of a glued joint 48.3 with the internal projection 25 in the central region 24 of the bottom 22. A form-locking connection in the rear coupling region 42 is provided by means of a non-illustrated glueing of the front end face 41 of the supporting element 40 with rear end surface 11 of the tail section 12. By means of a thinned and consequently weakened wall portion 50, (50') at the outer, respectively inner, side of the walls of element 40, there is obtained a corresponding receiving region 46, (46') for elastically receiving pressure forces, in the direction of the central axis A. Further details regarding this embodiment can be gleaned from the description of the embodiment of FIG. 1.

Figure 3:
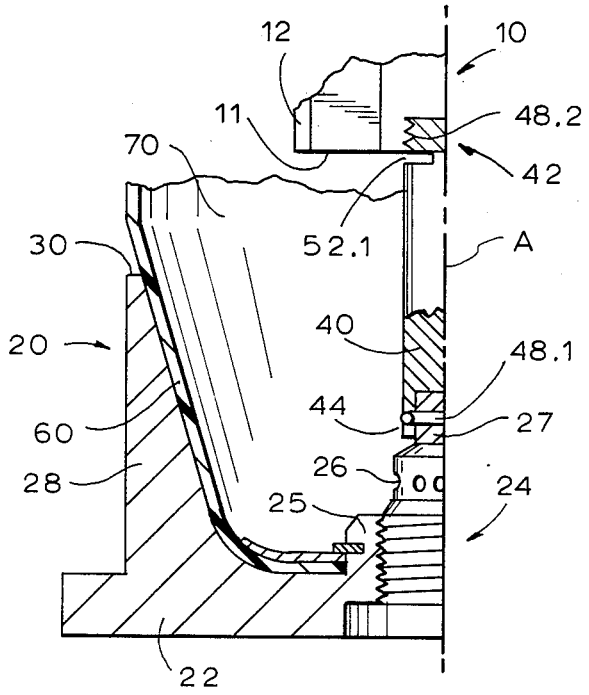

In the embodiment in accordance with FIG. 3 a stump shell casing 20 has a continuously increasing wall thickness between the front end walls surface 30 and the bottom 22. The combustible casing or housing 60 is mounted inside the stump shell casing 20 and is secured thereto in the region of the central projection 25 in a manner not described in detail. A propellant charge ignition fuse 26 has a forwardly extending projection 27. This projection 27 defines the coupling region 44 in which the support element 40 is form-lockingly connected by means of a rod 48.1 with the stump housing 20. In this embodiment the support element 40 is constructed as a massive round rod. This rod extends the central axis A and its forward end extends into the rear coupling region 42 in which a form-locking connection between the support element 40 and tail section 10 is effected. In the immediate vicinity of the rear end surface 11, the support element 40 has a groove 48.2 which serves as a fracture line. In this embodiment the support element 40, advantageously formed as a rod-shaped powdered body, has a cross-section that is preselected to assure the formation of a predetermined initial pressure prior to its disintegration.

Figure 4:
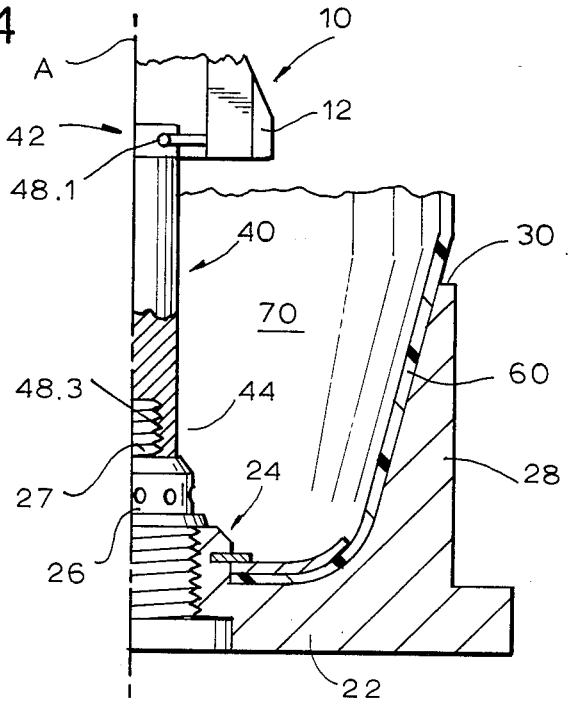

The support element 40 is also formed as a massive round rod in the embodiment of FIG. 4. The element 40 is form-lockingly connected in the coupling region 44 of the stump shell casing bottom 22 via threaded portion 48.3 which threadably engages with the forwardly projecting portion 27 of the propellant charge ignition fuse 26. In the coupling region 42 the mutual form-locking is effected by means of a rod 48.1. When the support element 40 is made out of powdered material, as has been described in connection with the embodiment of FIG. 3, such as for example nitrocellulose, the cross-section of the element 40 is selected so as to furnish the required initial expulsion pressure. When the support element 40 is, on the other hand, made out of a material which corresponds to that of the shell casing 60, the rod 48.1 can be formed as a shear rod which is sheared off when the predetermined shearing force is applied. Also in this manner the preselected initial pressure is furnished.

Figure 5:
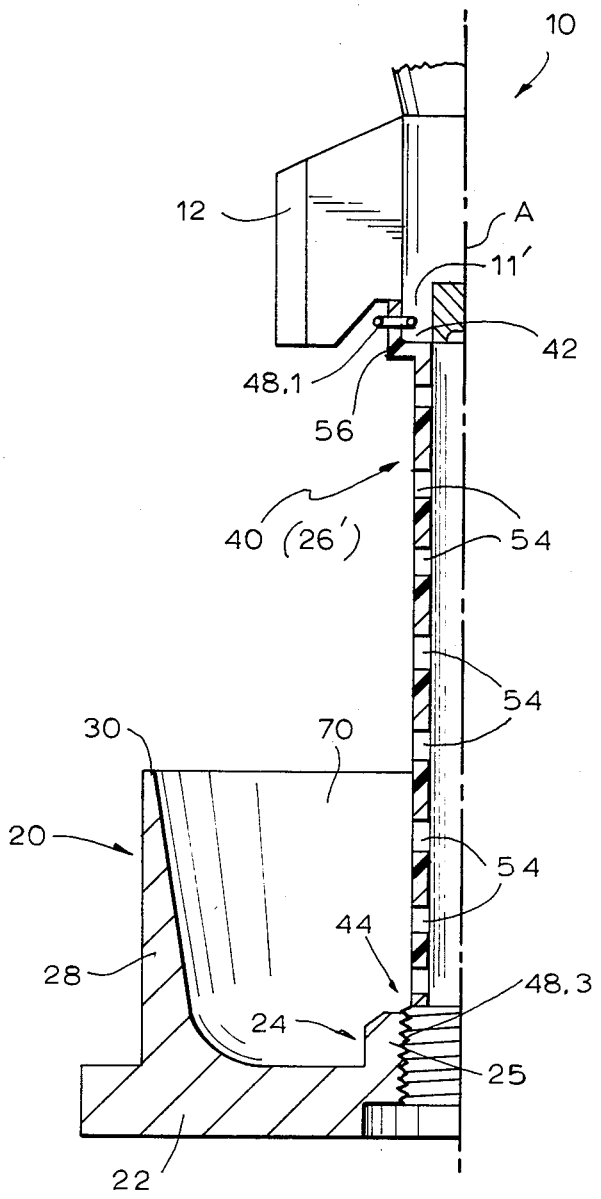

In the embodiment of FIG. 5 (in which, as well as in FIGS. 6–8, the combustible parts of the propellant charge casing have not been illustrated) the support element 40 is formed as a pipe having a plurality of ignition openings, which takes over the function of propellant charge igniter 26'. This support element 40 is form-lockingly connected in the coupling region 44 by means of a threaded portion 48.3 with the stump casing 20 and extends forwardly along the central axis A into the coupling region 42, where an expanded portion 56 thereof matingly embraces a cylindrical tail portion 11' of the projectile. A form-locking between the support element 40 and the tail section 10 is achieved by means of a rod 48.1 in the coupling region 42. The support element 40 is made of a material which corresponds advantageously to that of the non-illustrated combustible casing; the rod 48.1 is consequently formed as a shear rod which will shearingly fail when a predetermined load is applied thereto.

Figure 6:
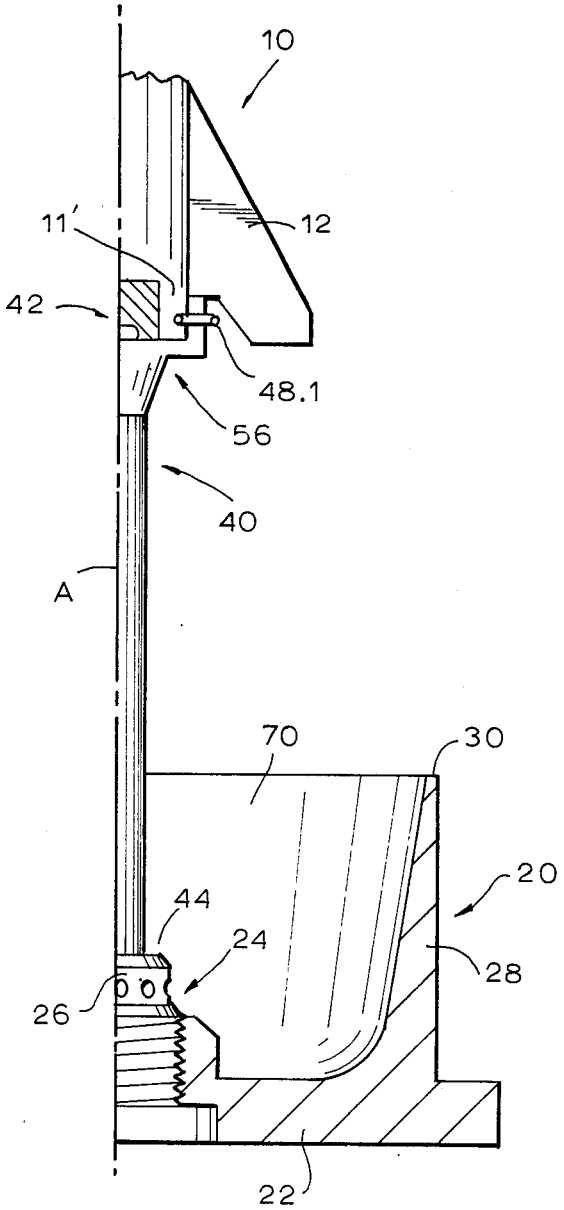

In the embodiment of FIG. 6 the support element 40 is substantially formed as a massive round rod having a forwardly extending expanded portion 56. This expanded portion 56 matingly fits over the tail portion 11' of the projectile and is form-lockingly connected by means of the connecting rod 48.1. The form-locking connection between the support element 40 and the stump casing 20 in the coupling region 44 is not illustrated in detail, but corresponds substantially to those described hereinabove.

Figure 7:
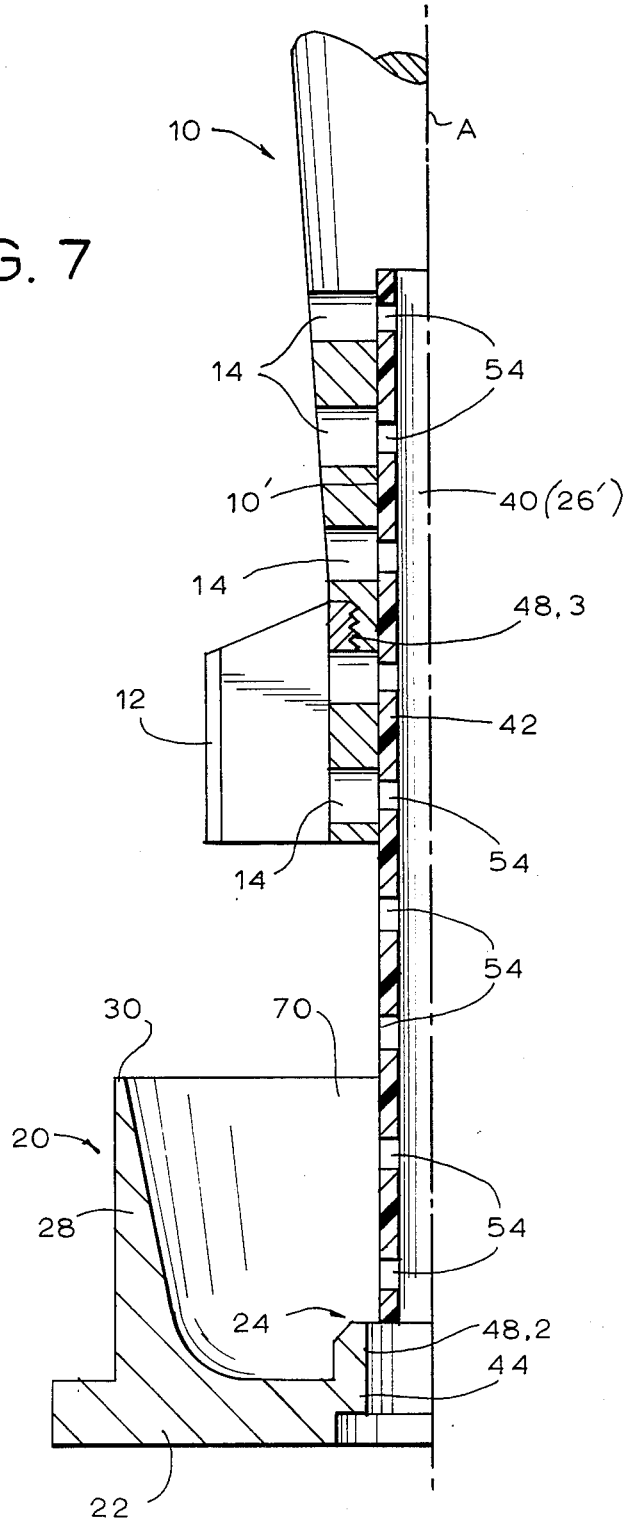

In the embodiment of FIG. 7 the support member 40 is again formed as a pipe having a plurality of ignition openings 54 which functions simultaneously as a propellant charge igniter 26'. It extends the central axis A into the central bore 10' of the tail section 10 of the projectile. The rear coupling region 42 extends along the entire depth of the bore 10', whereby the ignition opening 54 of the member 40 align with the transverse bores 14 disposed in the tail section 10. The mutual form-locking between the support element 40 and tail section 10 in the coupling region 42 is effected by means of a glued joint 48.3.

Figure 8:
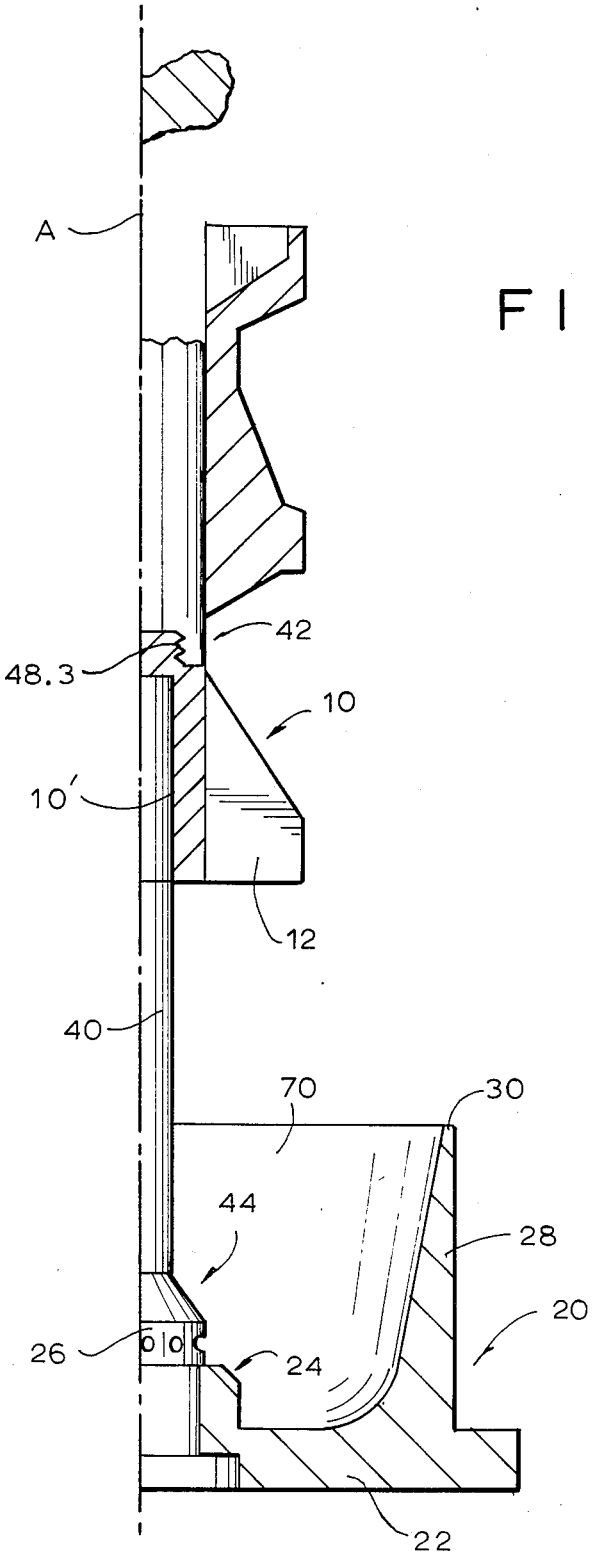

In the embodiment of FIG. 8 the support element 40 is formed as a massive round rod. A form-locking is achieved in the coupling region 44 between element 40 and stump casing 20 in a non-illustrated manner but which corresponds to the descriptions set forth hereinabove. The tail section 10 has here also a central bore 10', the longitudinal extent of which along the central axis A, corresponds substantially to that of the fin stabilizing arrangement 12. The bore 10' defines the rear coupling region 42; the corresponding form-locking connection is effected by means of a glued joint 48.3.

Figure 9:
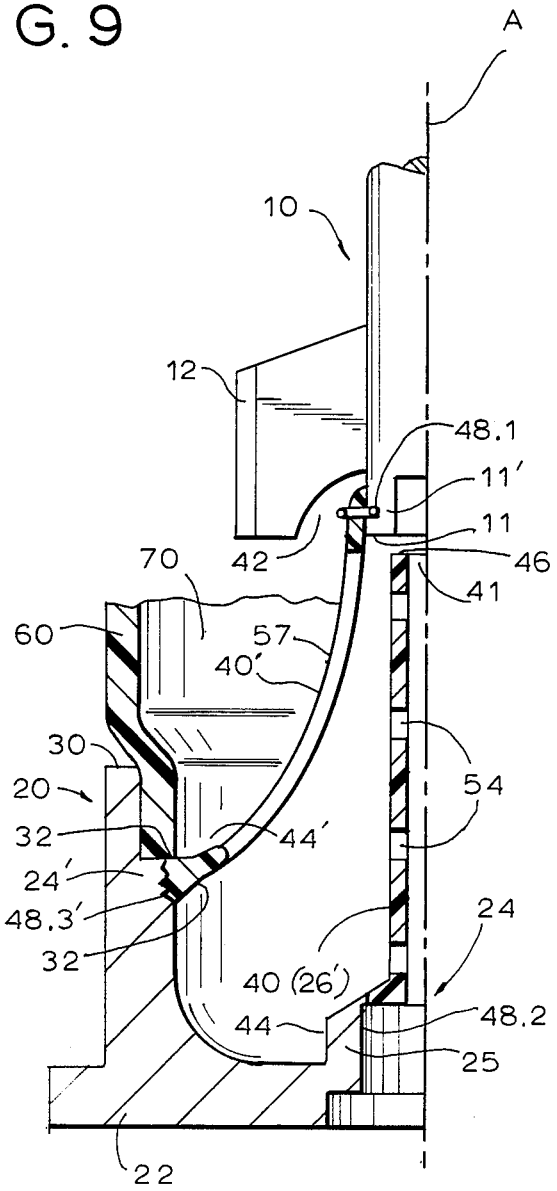
Figure 10:
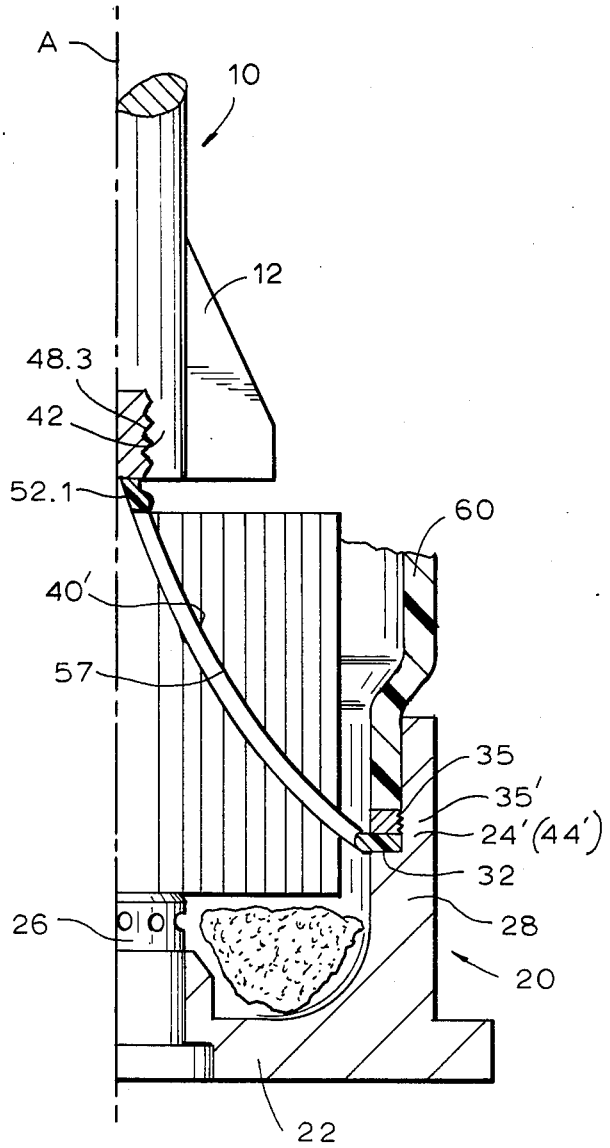

The two embodiments in accordance with FIGS. 9 and 10 also have a stump shell casing 20 the wall 28 of which has an inner wall surface. In the embodiment of FIG. 9 the support member 40, which is again constructed as a pipe with a plurality of ignition openings 54 and is threadably connected by means of the threaded portion 48.2 in the projection 25 to the stump shell casing 20. The member 40 functions also here as a propellant charge igniter 26'. It terminates with its forward end face 41 in confronting relationship and is axially spaced at a distance 46 from the rear end surface 11 of the tail section 10. A second substantially funnel-shaped support member 40' extends from the side wall region 24' of the stump shell casing 20, at the location where the inner wall 28 exhibits a stepped surface 32', forwardly up to the tail region 42, where it matingly engages with the outer surface of the tail portion 11' of the projectile 10. The form-locking connection in the coupling region 42 is effected by means of a rod 48.1. In the location 24' of a coupling region 44' disposed inside the stump shell casing 20, the support element 40' is form-lockingly connected by means of a glued joint 48.3 with the stump shell casing 20. Openings 57 in the walls of the support element 40' ensure that a uniform ignition of the propellant charge is effected, which charge is disposed in the inner space 70 of the shell casing but is not illustrated for sake of clarity. In the afore-described embodiment a pressure force acting in the direction of the central axis A can first be elastically absorbed by the support element 40'. As soon as the distance 46 between the rearwardly facing tail surface 11 and the forwardly facing end face 41 of the support element 40 has been traversed, the latter takes over the absorption of corresponding axial pressure forces.

The embodiment of FIG. 10 has a funnel-shaped support element 40' with a plurality of openings 57. This element 40' is form-lockingly connected at the inner stepped surface 32 of the wall 28 to the stump shell casing 20 in a coupling region 24' by means of either a threaded or glued connection 35' formed by a screwed in or glued ring 35 and, if necessary, by means of directly glueing it to the wall 28. The coupling region, disposed inside the shell casing, is consequently designated with the reference number 44'. In the rear coupling region 42 a form-locking connection is provided by means of the glued joint 48.3. A fracture line can be provided by means of a groove 52.1 in the vicinity of the glued joint 48.3, which is dimensioned in dependence with the materials used for the arrangement. In this embodiment a propellant charge 80 is schematically illustrated. The uniform ignition of this propellant charge 80 is made possible by means of the element 26, ignition occurring via the opening 57. In the afore-described embodiment a pressure force acting in the direction of the control axis A of the projectile 10, 12 can be elastically absorbed by the connecting member 40'. Further constructional details can be gleaned from the preceding descriptions of the other embodiments of the invention.

With cartridge ammunition of the afore-described type an important prerequisite is that after each firing, in addition to the removal of the stump shell casing 20 from the breech, no other parts should remain in the gun barrel. Insofar as the material for the respective support element 40 and/or connecting member 40' corresponds to that of the at least partially combustible propellant charge shell casing, this prerequisite is met by the not yet completely combusted broken parts being expelled by the propelling gases through the muzzle. When the support element 40 and/or connecting member 40' is formed as a body formed out of powder, a substantially residue-free combustion is achieved. This indicates that any material, which has the afore-mentioned property and meets the strength and machinability requirements, is suitable.

The afore-described form-locking connections between the stump shell casing and the tail section of the projectile assure that a predetermined axial tensional force occurs in the connecting member 40' during firing of the ammunition due to the gas pressure buildup in the shell casing.

Although the invention is illustrated and described with reference to a plurality of embodiments thereof, it is to be expressly understood that it is in no way limited to the disclosure of preferred embodiments, but is capable of numerous modifications within the scope of the appended claims.

We claim:

1. Improved cartridge ammunition comprising a projectile having a tail section with flight stabilizing means and a propellant charge shell casing made of a combustible material, said casing having a neck and a rear portion for receiving said tail section, a metallic stump forming a bottom for said casing; said projectile is connected to the shell casing at said neck by means of first connection means and by means of second connection means between the tail section of the projectile and the metallic stump of the shell casing, said second connection means including a support element, the improvement comprising, a support region for said second connection means disposed inside said metallic stump of said shell casing and being axially spaced from the bottom of the said shell casing and from the bottom of the metallic stump, said support element coaxially extending between said tail section and the support region of said metallic stump of said shell casing and connecting said tail section to said metallic stump at said support region, said support element being made of a combustible material and providing a form-locking axially extending connection between said projectile and said metallic stump which inhibits a loosening of said projectile on loading, unloading, and reloading said ammunition unit, and assuring that a predetermined axial tensional force occurs in said support element between said tail section and said metallic stump due to gas pressure build-up at firing of the ammunition.

2. Improved cartridge ammunition comprising a projectile having a tail section with flight stabilizing means and at least a partially combustible propellant charge casing having a forwardly facing open mouth, the rear end of said at least partially combustible casing being rigidly mounted in a metallic stump casing, said projectile being mounted in said open casing mouth and being connected to said partially combustible substantially cylindrically shaped propellant charge casing at its open mouth, a connecting element also operatively coaxially connecting the tail section of said projectile to said stump casing, the rear end of said connecting element being coaxially spaced a predetermined distance from the bottom of said stump casing, whereby when a predetermined pressure build-up has occurred in said casing after firing of the ammunition a predetermined axial tensional force is imparted on the connecting element and causes a rupture thereof, the improvement comprising, said connecting element being tubularly shaped and having a continuously increasing diameter from said tail section to said metallic stump and being forwardly tapered and having such stiffness and elasticity that it can absorb axial and radial pressure forces, said axial pressure forces being rearwardly directed.

3. The improved cartridge ammunition as set forth in claim 2, wherein said improvement comprises, including a cylindrical tube which has a plurality of openings in its cylindrical wall surface for the purpose of functioning as an ignition tube, said tube is coaxially mounted in said propellant charge casing and is form-lockingly connected to the bottom of said stump casing, the upper end of said cylindrical tube is axially spaced a predetermined slight distance from the tail section of said projectile so that upon ignition of said ammunition axial pressure forces are first of all elastically absorbed by said connecting element which deforms whereupon the tail section of the projectile contacts the upper end of said tube for further absorption of axial pressure forces.

4. The improved cartridge ammunition as set forth in claim 3, wherein said tube is made of combustible material.

* * * * *